US007698749B2

(12) United States Patent
Littlejohn

(10) Patent No.: US 7,698,749 B2
(45) Date of Patent: Apr. 20, 2010

(54) TOTAL TIE KEEP

(76) Inventor: Dwight Littlejohn, 13058 Tavemer Loop, Woodbridge, VA (US) 22192

( * ) Notice: Subject to any disclaimer, the term of this patent is extended or adjusted under 35 U.S.C. 154(b) by 96 days.

(21) Appl. No.: 11/979,569

(22) Filed: Nov. 6, 2007

(65) Prior Publication Data

US 2008/0307558 A1 Dec. 18, 2008

Related U.S. Application Data

(60) Provisional application No. 60/934,323, filed on Jun. 14, 2007.

(51) Int. Cl.
*A41D 25/04* (2006.01)

(52) U.S. Cl. ..... 2/145

(58) Field of Classification Search ..... 2/144, 2/145, 146–151, 152.1, 153–157; 24/54, 24/65, 66.1

See application file for complete search history.

(56) References Cited

U.S. PATENT DOCUMENTS 3,474,503 A * 10/1969 Less ..... 24/56
4,920,579 A 5/1990 Swain
5,245,708 A * 9/1993 Campelia et al. ..... 2/145
5,315,713 A 5/1994 Pileggi
5,353,438 A 10/1994 Voiles
5,813,053 A 9/1998 Pileggi
5,815,836 A 10/1998 Jacobson, II
7,065,794 B2 6/2006 Anderson

* cited by examiner

*Primary Examiner*—Tejash Patel
(74) *Attorney, Agent, or Firm*—The Law Firm of Andrea Hence Evans, LLC

(57) ABSTRACT

Apparatus for restraining a necktie; the necktie has a front portion, a rear portion and a label attached to a back side of the front portion of the necktie. The apparatus includes a material having upper, middle and lower button holes that connect with upper, middle and lower buttons on the shirt. A first tab and a second tab are attached to the material and form a first loop and a second loop with the material such that said rear portion of said necktie is inserted through the first loop or the second loop. The first tab is positioned below the upper button hole and above the middle button hole and the second tab is positioned below the middle button hole and above the lower button hole on the apparatus. A tied necktie secured to the collar of the shirt is attached to the apparatus by connecting a first button on the shirt to a first button hole on the material. The rear portion of the necktie is inserted through the first or second tab on the material. The apparatus and connected rear portion of the necktie are inserted through a label on a back-side of the front portion the necktie. Then, the middle and lower button holes are connected to the middle and lower buttons on the users shirt.

5 Claims, 11 Drawing Sheets

TOTAL TIE KEEP

RELATED U.S. APPLICATION DATA

This application claims the benefit of provisional application No. 60/934,323, filed Jun. 14, 2007.

TECHNICAL FIELD

The present invention relates to an apparatus to restrain the rear portion of a necktie to prevent movement of the neck tie and to provide an overall neat appearance.

BACKGROUND OF THE INVENTION

The rear portion of a necktie is typically restrained by a label attached to the back side of the front portion of the tie. To further secure the tie to the users shirt, tie tacks, pins and tie clasp are used to further hold the tie in place. Although these conventional methods of securing neckties are effective, they do not address or solve the difficulties associated with securing the rear portion of a necktie so that the user has an overall neat appearance and unnecessary movement of the necktie is avoided.

Various necktie restraints are currently in use, but they do not involve an apparatus with button holes and tabs attached to the material such that the necktie is secured by the button holes, buttons on the users shirt, tabs on the apparatus and the label on the necktie.

SUMMARY OF THE INVENTION

It is the object of the present invention to provide an apparatus to restrain the rear portion of a necktie preventing unnecessary lateral movement of the necktie.

It is a further object of the present invention to provide an apparatus to restrain a necktie which embodies a design and construction such that the apparatus is easily detachable and separate from the necktie to provide cost effective use with multiple ties.

It is another object of the present invention to provide an apparatus to restrain a necktie such that the apparatus size allows it to be inserted into a neckties label to aid in further limiting the neckties overall movement.

It is another object of the present invention to provide an apparatus that allows the user to choose where the user will attach the device to the users shirt. The user can choose a desirable button on the users shirt to attach the apparatus to the desired button hole on the apparatus. The apparatus can accommodate users of any size, height or weight.

The present invention discloses an improved apparatus for restraining a necktie. The front portion of the necktie is defined as the wide end portion of the necktie. The rear portion of the necktie is defined as the narrow end portion. The rear portion of the necktie is secured to the apparatus to prevent unnecessary movement of the tie.

It will be clear from the description below that many other shapes of the material could also be adopted based on the design of the shirt and necktie. Additional buttons on the users shirt and additional button holes on the apparatus could be added and utilized. Furthermore, the tabs can be secured by any known attachment method such as glue, fabric tape and other attachment methods. Lastly, the material can be made from the same fabric and design of the necktie to further blend or camaflouge while in use.

Preferably, the apparatus is a cotton or polyester blend rectangular shaped material with three button holes, an upper, middle and lower button hole, positioned for contact with three buttons on the user's shirt, upper, middle and lower buttons. The upper button is defined as the button on the user's shirt that coincides or aligns with the upper button hole on the apparatus. Depending on the way the user desires the tie to lie on the shirt or fall on the shirt, the upper button will vary on the shirt. However, the upper button is aligned and secured to the upper button hole. Similarly, the middle button and lower button on the users shirt are the buttons aligned or secured to the middle button hole and lower button hole, respectively. Two sewn tabs are secured to the material to support the rear portion of the necktie. The tabs extend across the width of the apparatus. Width is defined as the horizontal distance along the x-axis. Length is defined as the vertical distance along the y-axis. A first tab is positioned below the upper button hole and above the middle button hole and a second tab is positioned below the middle button hole and above the lower button hole. The lower edge of the first tab is at least 3¼ inches away from the upper edge of the second tab along the y-axis. The tabs are at least ⅜ inches long from the top edge of the tab to the lower edge of the tab. The material is at least 1/16 inches thick, at least 1¾ inches wide and at least 8 inches long. The button holes are at least ½to ¾ inches long. The bottom of the upper button hole is 2¾ inches from the top of the middle button hole. The bottom of the middle button hole is 2¾ inches from the top of the lower button hole. The button holes are centered ⅞ inches from the left and right edges of the material. The top of the upper button hole is ¼ inches from the top edge of the material and the lower button hole is ¼ inches from the top of the lower edge of the material. Variations of the size of the buttons and spacing can be altered based on the shirt design. The edge of the material is defined as the upper and lower boundaries of the material along the x-axis. Each tab is spaced at least 2 inches from the upper edge and lower edge of the material. The dimensions of the apparatus provide optimum restraint of the necktie.

The first tab and second tab form a first loop and a second loop with the material such that the rear portion of the necktie can be downwardly inserted behind the first loop and second loop. A label is provided on the back side of the front portion of the necktie. The apparatus is designed such that the material and the rear portion of the necktie are downwardly inserted behind the label such that the material and rear portion of the necktie are further secured to the back side of the front portion of the necktie by the label.

After securing a tied necktie to the collar of the user's shirt, the apparatus can be properly used. The upper button on the users shirt is connected to the upper button hole on the material. Then, the rear portion of the necktie is downwardly inserted through the first tab. If the necktie's lower rear portion extends over the second tab, the lower rear portion is downwardly inserted through the second tab. After the rear portion of the necktie is secured behind the first and second tabs or simply the first tab, the lower portion of the apparatus, along with attached the inserted rear portion of the necktie, is downwardly inserted through the label on the back side of the front portion of the necktie. The apparatus and rear portion of the necktie are pulled through or threaded through the label until the apparatus and rear portion of the tie are flat against the shirt. At this point, the lower button hole is aligned with the lower button on the users shirt. The lower button on the users shirt is connected to the lower button hole on the material. The middle button on the users shirt is aligned with the middle button hole on the apparatus. It is optimal to connect the middle button to the middle button hole on the users shirt, however, this is not required. On occasion, the label on the necktie may align with the middle button on the shirt and the middle button hole on the apparatus. In this case, the middle button should not be connected to the middle button hole because if connected, the tie will buckle during normal movements.

After securing the apparatus to the necktie, gently pull the rear portion of the necktie to provide an overall neat appearance.

The tabs on the apparatus prevent the rear portion of the necktie from being visible to onlookers since lateral movement of the rear portion of the necktie is prevented. Furthermore, securing the apparatus along with the rear portion of the necktie prevents the entire necktie from moving around wildly. The user will be more confident since the necktie will remain clean, neat and secure.

Alternatively, the user may downwardly insert the tie through the first tab and then connect the upper button on the users shirt to the upper button hole on the apparatus. After the rear portion of the necktie is threaded through the first tab, the user can button the shirt to the apparatus by the upper button hole on the apparatus and the upper button on the users shirt. Then, if the necktie's lower rear portion extends over the second tab, the lower rear portion is downwardly inserted through the second tab. After the rear portion of the necktie is secured behind the first and second tabs or simply the first tab, the lower portion of the apparatus, along with the attached inserted rear portion of the necktie, is downwardly inserted through the label on the back side of the front portion of the necktie. The apparatus and rear portion of the necktie are pulled through or threaded through the label until the apparatus and rear portion of the tie are flat against the shirt. The lower button and middle button on the users shirt are connected to the lower button hole and middle button hole on the apparatus.

In one embodiment, the rear portion of the necktie is inserted or threaded through the first tab only. In this embodiment, if the rear portion of the necktie is not long enough, such that it does not extend over the second tab, the rear portion of the necktie is threaded through the first loop only. The apparatus is used in the same manner described above such that the buttons are connected to the button holes and the threaded rear portion and apparatus together are inserted behind the label.

In another embodiment, the apparatus is not inserted into the label. If the necktie does not have a label attached to the back side of the front portion of the necktie, the apparatus is designed to still properly restrain the rear portion of the necktie. After the rear portion of the necktie is secured behind the first and second tabs, the buttons on the users shirt are connected to the button holes on the apparatus. The upper, middle and lower button holes are connected to the upper, middle and lower buttons, respectively.

In another embodiment, the middle button hole on the apparatus is not connected to the middle button on the users shirt. The user can connect the upper and lower button holes to the upper and lower buttons on the users shirt. The rear portion of the tie is threaded through the first and second tabs and described above. The apparatus and attached rear portion are inserted downwardly through the label on the necktie.

DESCRIPTION OF THE DRAWINGS

The operation, features and advantages of the present invention should be apparent and fully understood when the following description is read in light of the accompanying drawings in which.

DETAILED DESCRIPTION OF THE DRAWINGS

Figure 1:
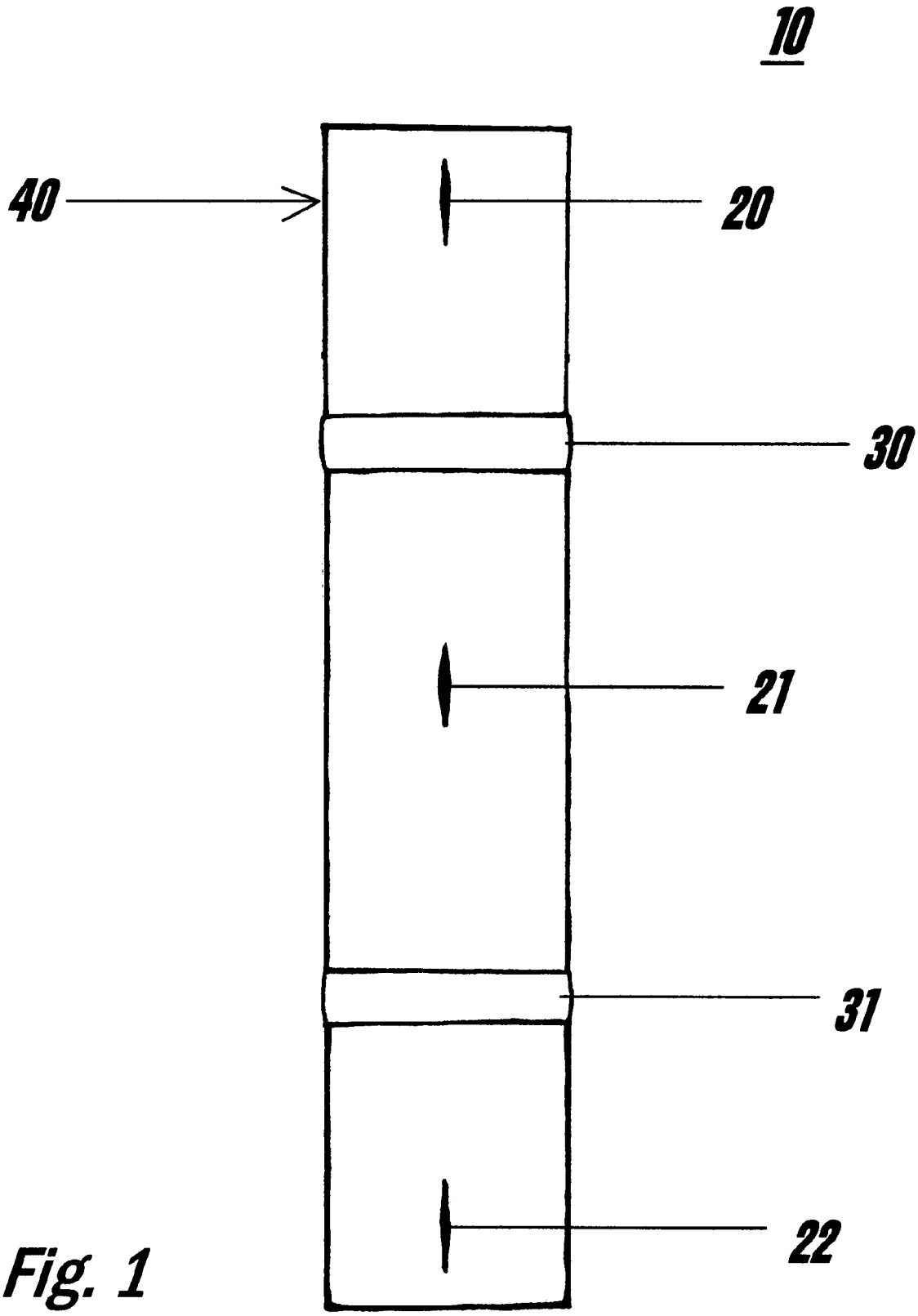
FIG. 1 is a front elevational view of the tie restraint apparatus of the present invention.
Figure 2:
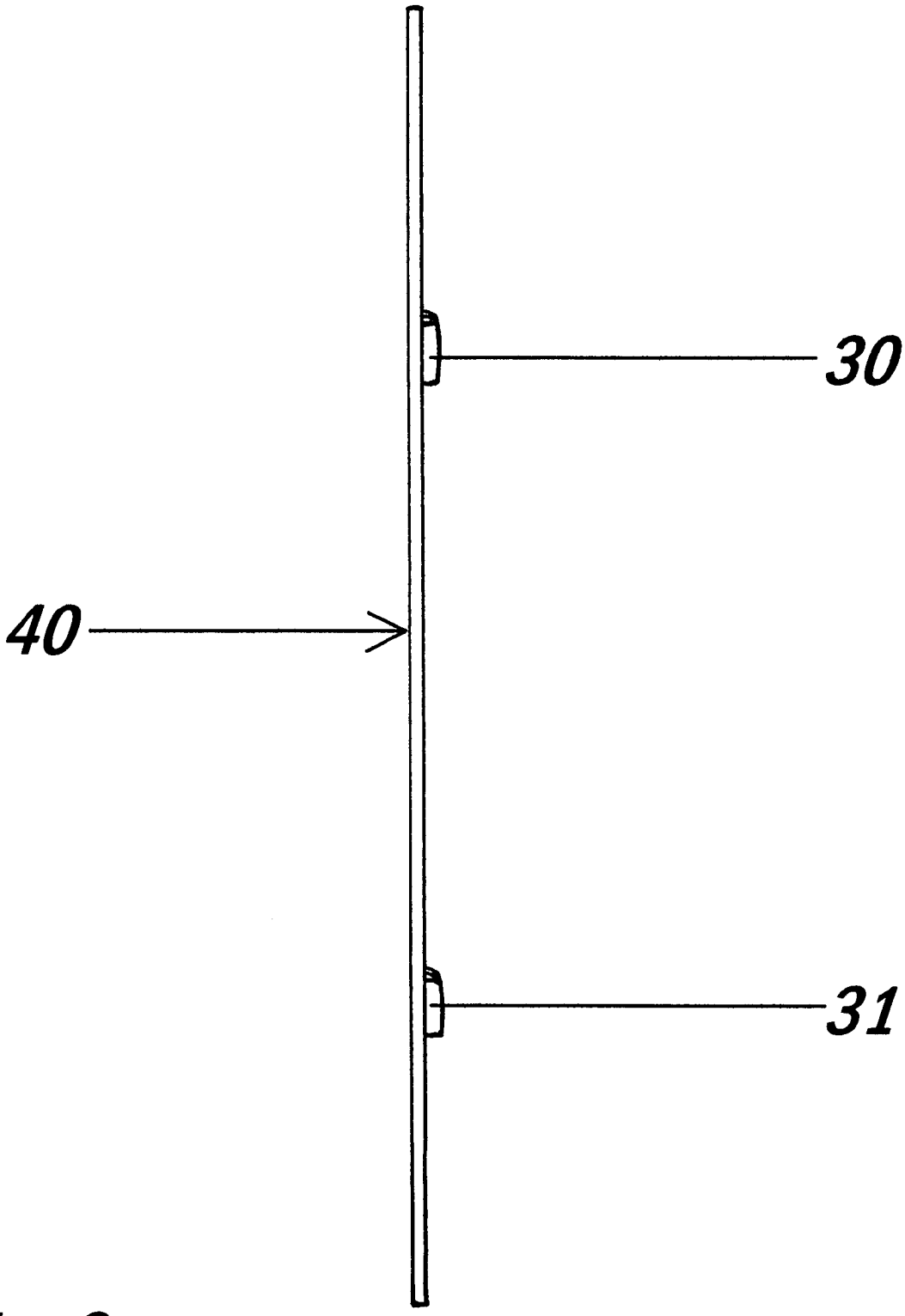
FIG. 2 is a side perspective view of the tie restraint apparatus of the present invention as shown in FIG. 1.

Referring to the figures, FIG. 1 is a front elevational view of the tie restraint apparatus 10. The tie restraint apparatus is in the form of a rectangular shaped material 40. The apparatus has an upper button hole 20, middle button hole 21 and lower button hole 22. A first tab 30 and second tab 31 are sewn on the material 40 such that the first tab 30 is positioned below the upper button hole 20 and above the middle button hole 21. The second tab 31 is positioned below the middle button hole 21 and above the lower button hole 22. As shown by the side view of the apparatus in FIG. 2, the first tab 30 and second tab 31 form a first and second loop with respect to the material 40. The tabs 30, 31 are formed as loops so that the rear portion 52 of the necktie 50, shown in FIG. 3, can downwardly be inserted through the first tab 30 and second tab 31 for support and restraint.

Figure 3:
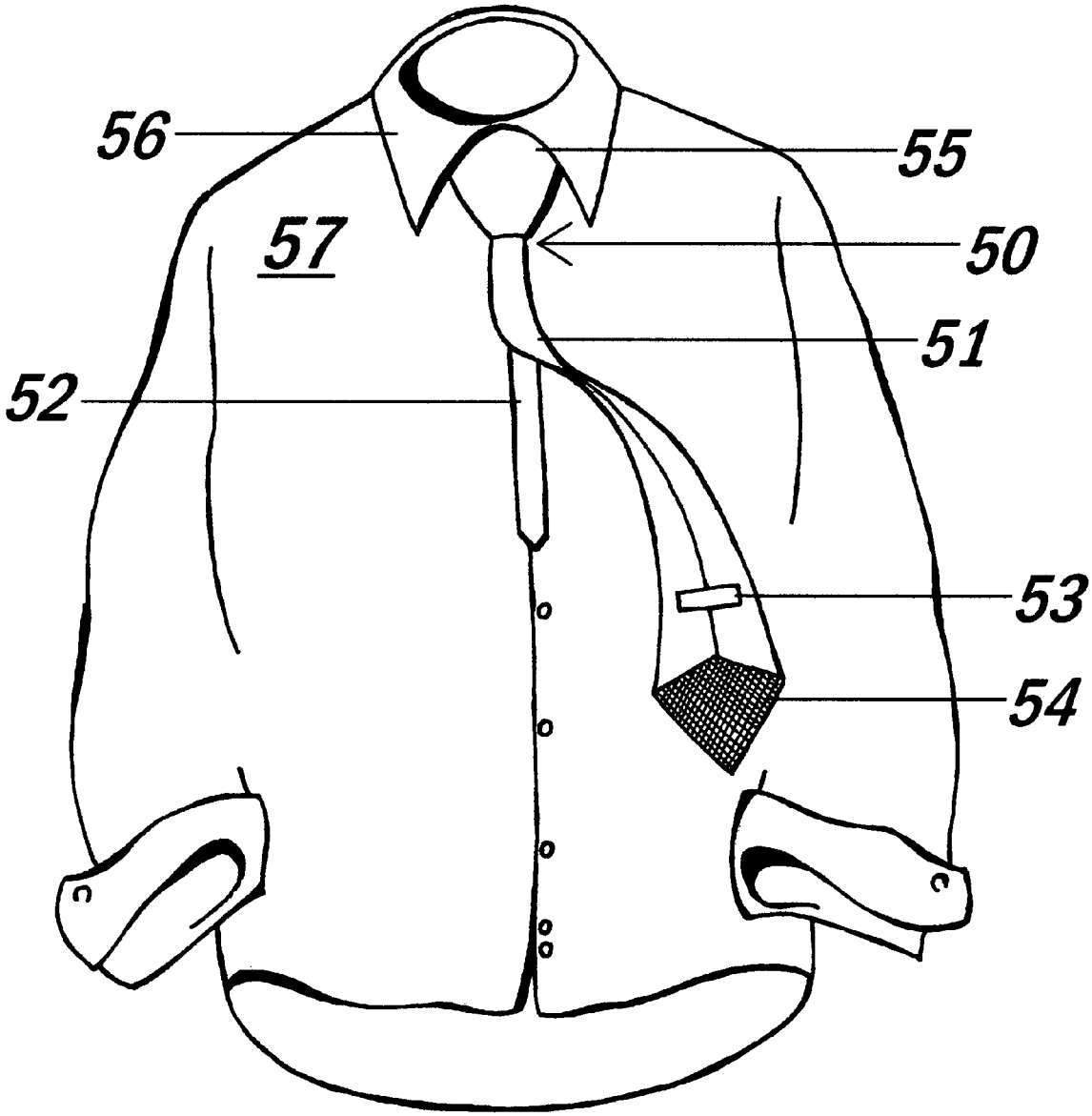
Fig. 3 Prior Art
FIG. 3 is a conventional tie shown with a rear portion, front portion and label tied on a conventional shirt.

For the purpose of disclosing the present invention, FIG. 3 illustrates a typical necktie 50 with a front portion 51 and a rear portion 52. A label 53 is located on the back side 54 of the front portion 51 of the necktie 50. The necktie 50 is tied in a knot 55 and secured around the collar 56 of a shirt 57. The label 53 typically has indicia such as the trade name of the necktie 50.

Figure 4:
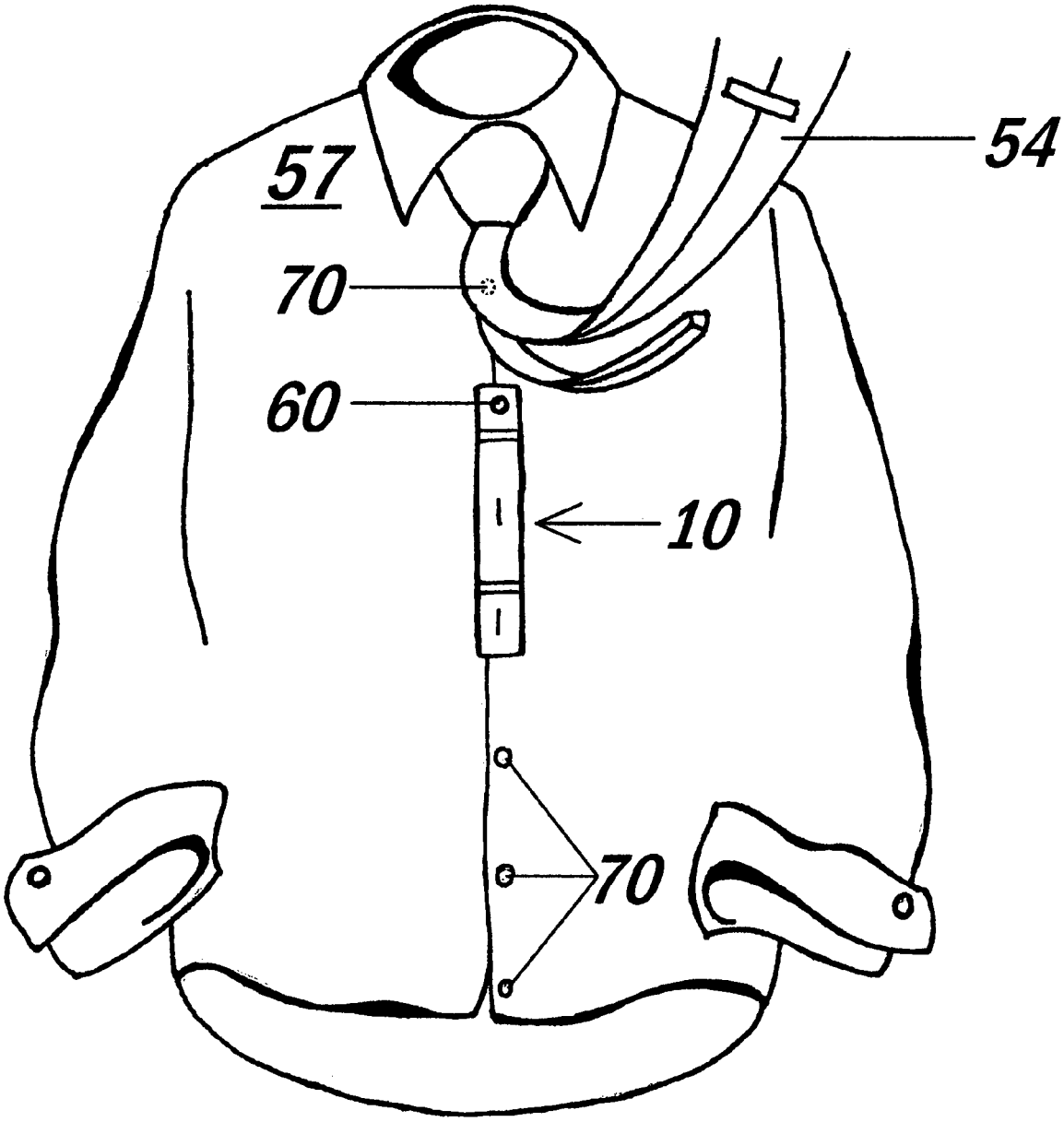
FIG. 4 is a front perspective view of the apparatus connected to the users shirt by an upper button on the users shirt and upper button hole on the apparatus.
Figure 5:
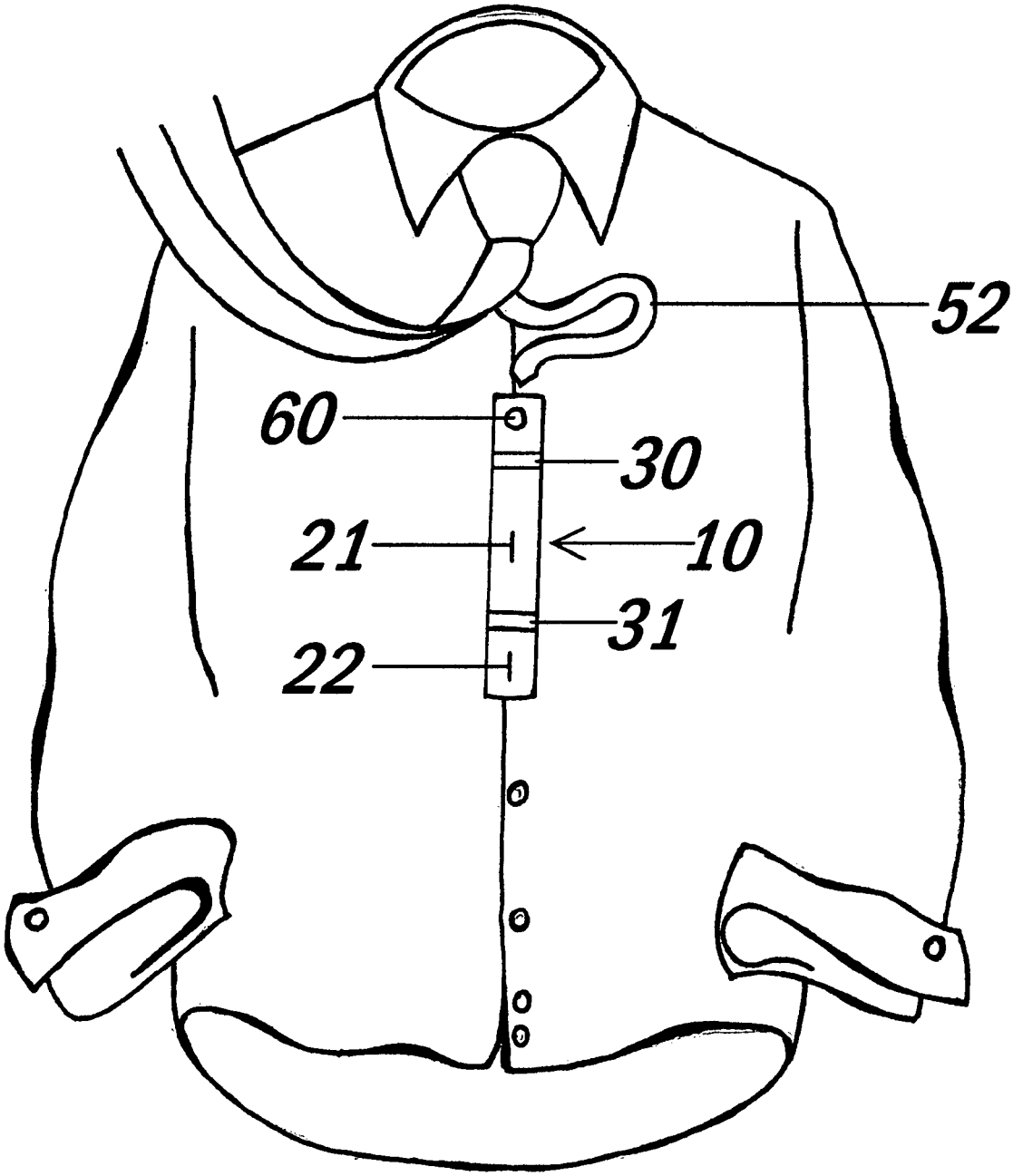
FIG. 5 is a front perspective view of the rear portion of the necktie being downwardly inserted through the first tab of the apparatus.

FIG. 4 demonstrates the upper button 60 on a shirt 57 buttoned to the upper button hole 20 on the apparatus 10. The necktie 50 is turned about 180 degrees to illustrate the apparatus of the present invention with respect to the necktie 50 on the shirt 57. The user may connect the apparatus 10 with a different button 70 depending on how the users likes to wear his necktie 50 in relation to his shirt 57, the height of the user, length of the tie and location of the label on the necktie. After the upper button 60 is secured to the apparatus 10, the rear portion 52 of the necktie 50 is tucked downwardly through the first tab 30, as shown in FIG. 5. The rear portion of the necktie 50 is gently pulled through the first tab 30 and over the middle button hole 21 and lower button hole 22 of the apparatus 10.

Figure 6:
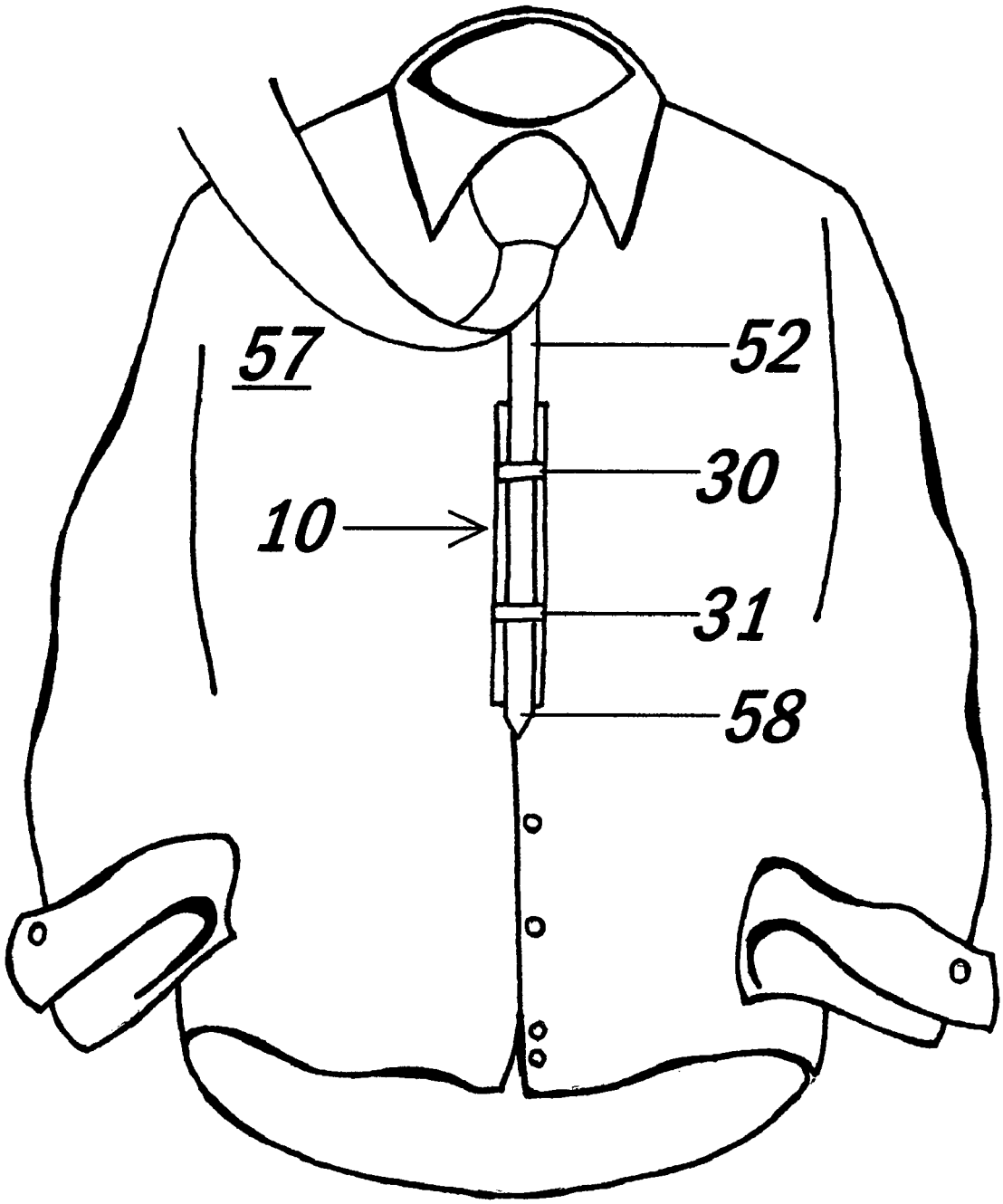
FIG. 6 is a further front perspective view of FIG. 5 of the rear portion of the necktie inserted downwardly through the first and second tab of the apparatus.

If the rear portion 52 of the necktie 50 is long enough to extend through the second tab 31, the rear portion 52 of the necktie 50 is pulled through the second tab 31, as shown in FIG. 6.

FIG. 6 shows the rear portion 52 of the necktie 50 connected by the upper button 60 on a shirt 57 and the upper button hole 20 on the apparatus 10. The rear portion 52 of the necktie 50 is shown inserted through both the first tab 30 and second tab 31. The lower rear portion 58 is shown extended over the apparatus 10. However, the length of the rear portion 52 of the necktie 50 may be shorter and is not required to extend over the apparatus 10.

Figure 7:
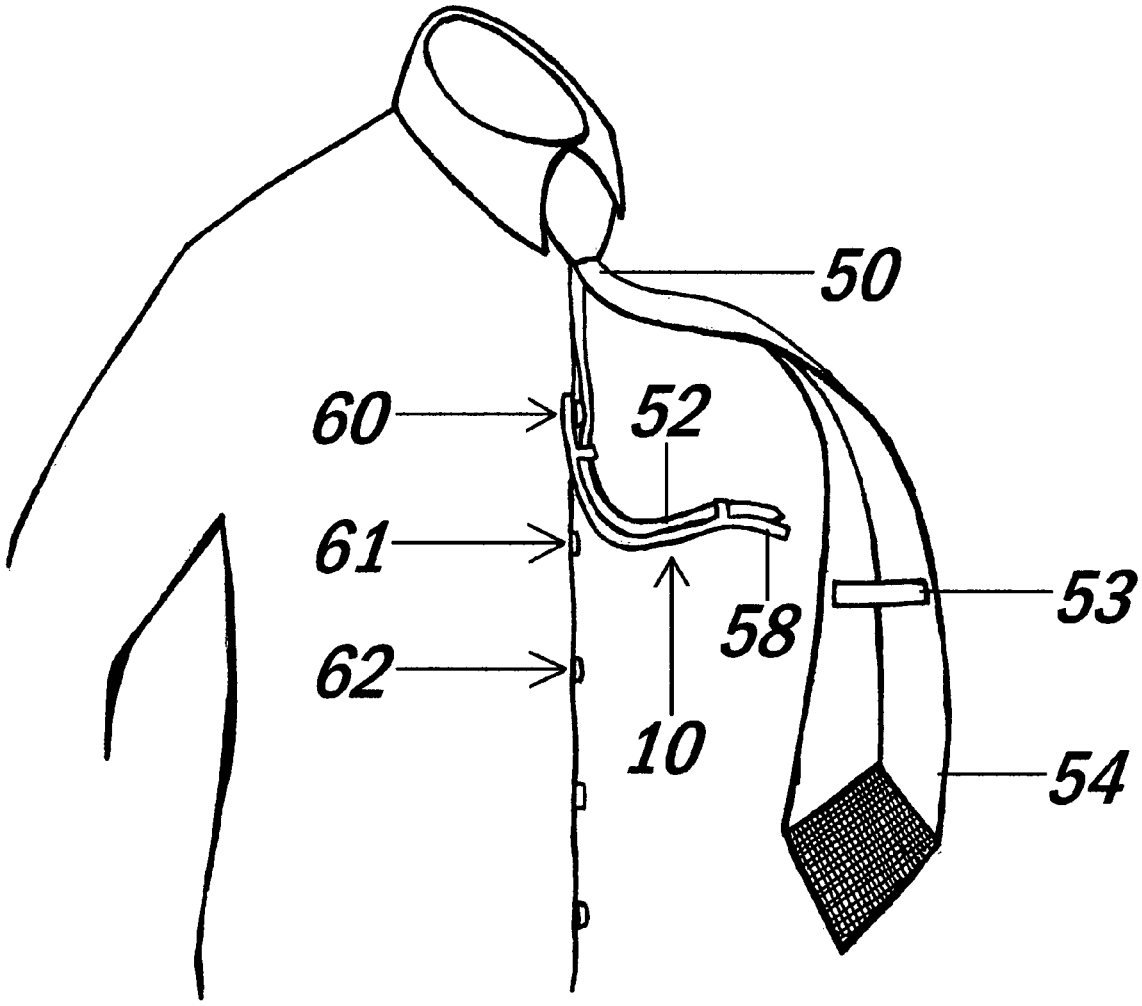
FIG. 7 is a side perspective view of the apparatus and rear portion of the necktie being downwardly inserted through a back label located on the back side of the front portion of the necktie.

As shown in FIG. 7, to further connect the necktie to the apparatus, the connected apparatus 10 and rear portion 52 of the necktie 50 are inserted together through the label 53 located on the back side 54 of the front portion 51 of the necktie 50 to further secure the necktie 50 and to prevent unnecessary movement of the necktie 50. The user grasps the lower rear portion 58 of the necktie 50, which is connected to the apparatus 10 by the upper button 60 and upper button hole 20 and threads it through the label 53 located on the back side 54 of the front portion 51 of the necktie 50. Now the front portion 51 of the necktie 50 is attached to the apparatus 10 by its label 53. The middle button 61 and lower button 62 on the shirt 57 can been seen in FIG. 7.

Figure 8:
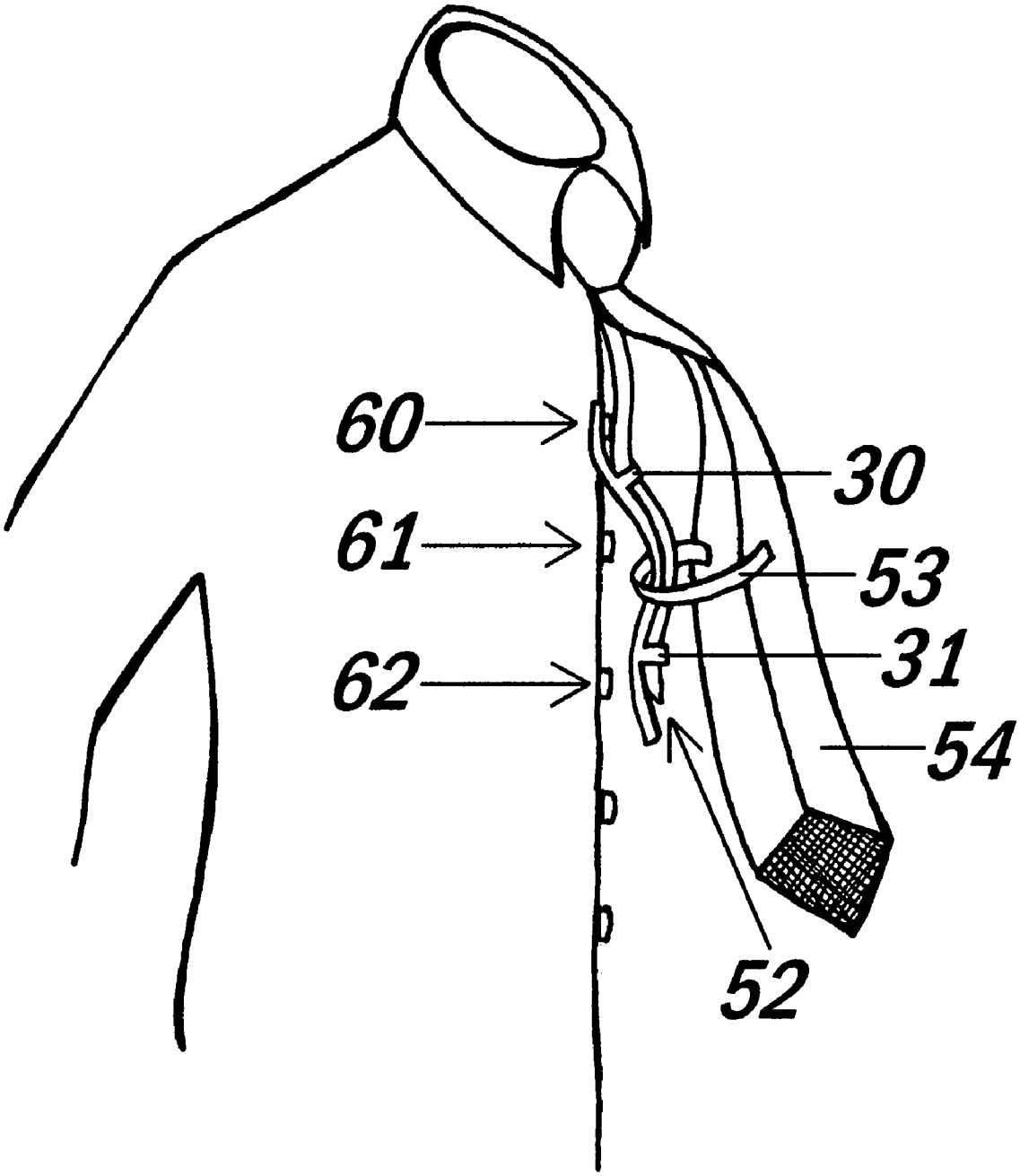
FIG. 8 is a side perspective view of the rear portion of the necktie and apparatus inserted through the label on the necktie and aligned with the middle and lower buttons on the users shirt.
Figure 9:
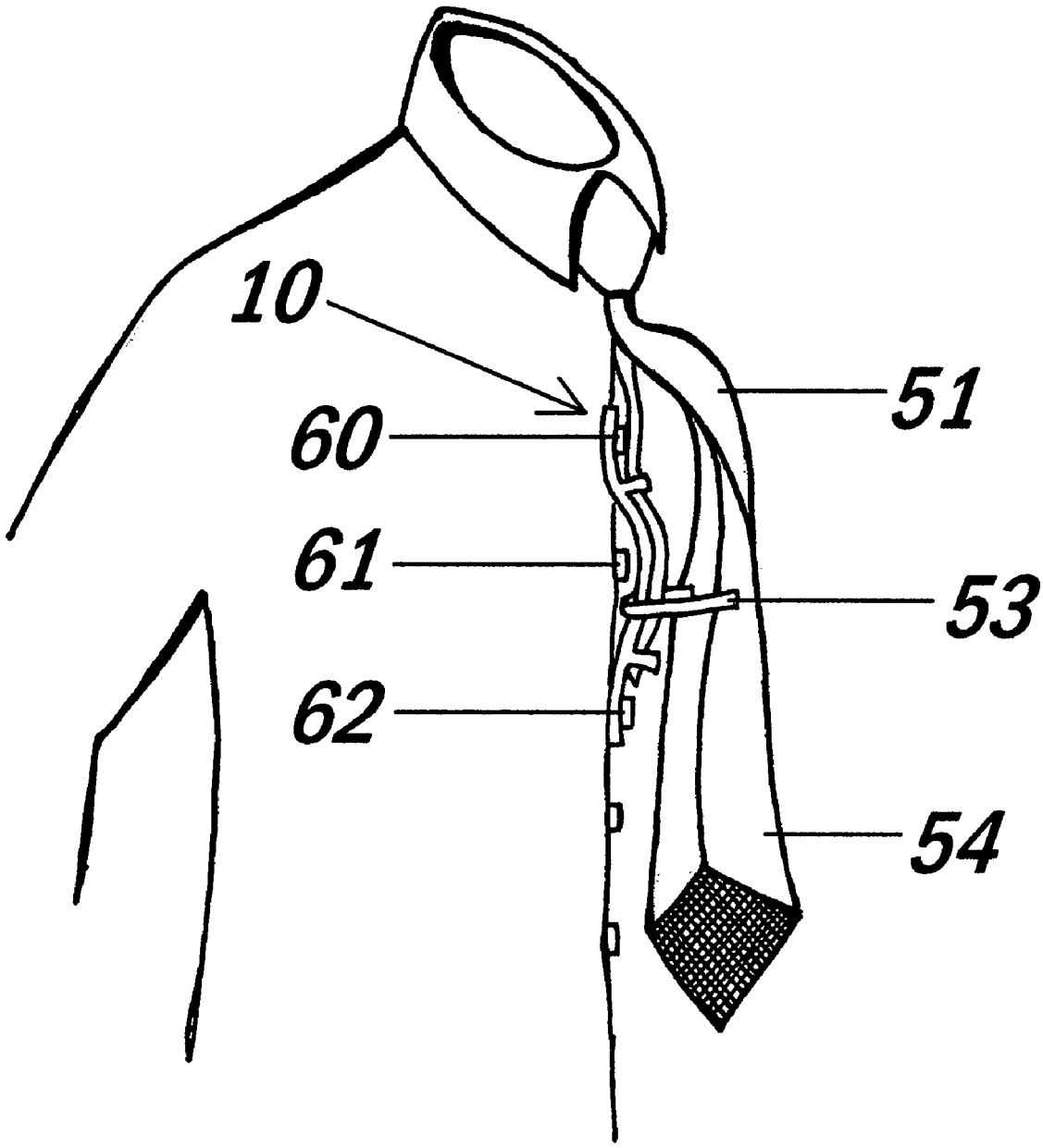
FIG. 9 is a side perspective view of the apparatus as shown in FIG. 8 with only the upper and lower button holes connected to the upper and lower buttons on the users shirt.

FIG. 8 illustrates a further side view of FIG. 7 of the apparatus 10 connected to the necktie 50. After the rear portion 52 of the necktie 50 and apparatus 10 are downwardly inserted through the label 53, the middle button hole 21 and lower button hole 22 on the apparatus 10 are aligned with the middle button 61 and lower button 52 on the shirt 57. Once the apparatus 10 and rear portion 52 of the necktie 50 are secure, smoothed and flattened against the users shirt 57, the lower button hole 22 is connected to the lower button 62 on the users shirt 57 as shown in FIG. 9. It is optimal to connect the middle button hole 21 with the middle button 61 on the users shirt 57, but not required. On occasion, the label 53 on the necktie 50 may align with middle button 61 on the shirt 57 and the middle button hole 21 on the apparatus 10. In this case, the middle button 61 should not be connected to the middle button hole 21 because if connected, the tie will buckle during normal movements.

Once the upper button hole 20 and lower button hole 22 are connected to the upper button 60 and lower button 62 on the shirt 57 or the upper button hole 20, middle button hole 21, and lower button hole 22 are connected to the upper button 60, middle button 61 and lower button 62, respectively, the apparatus 10 is securely attached to the necktie 50.

Figure 10:
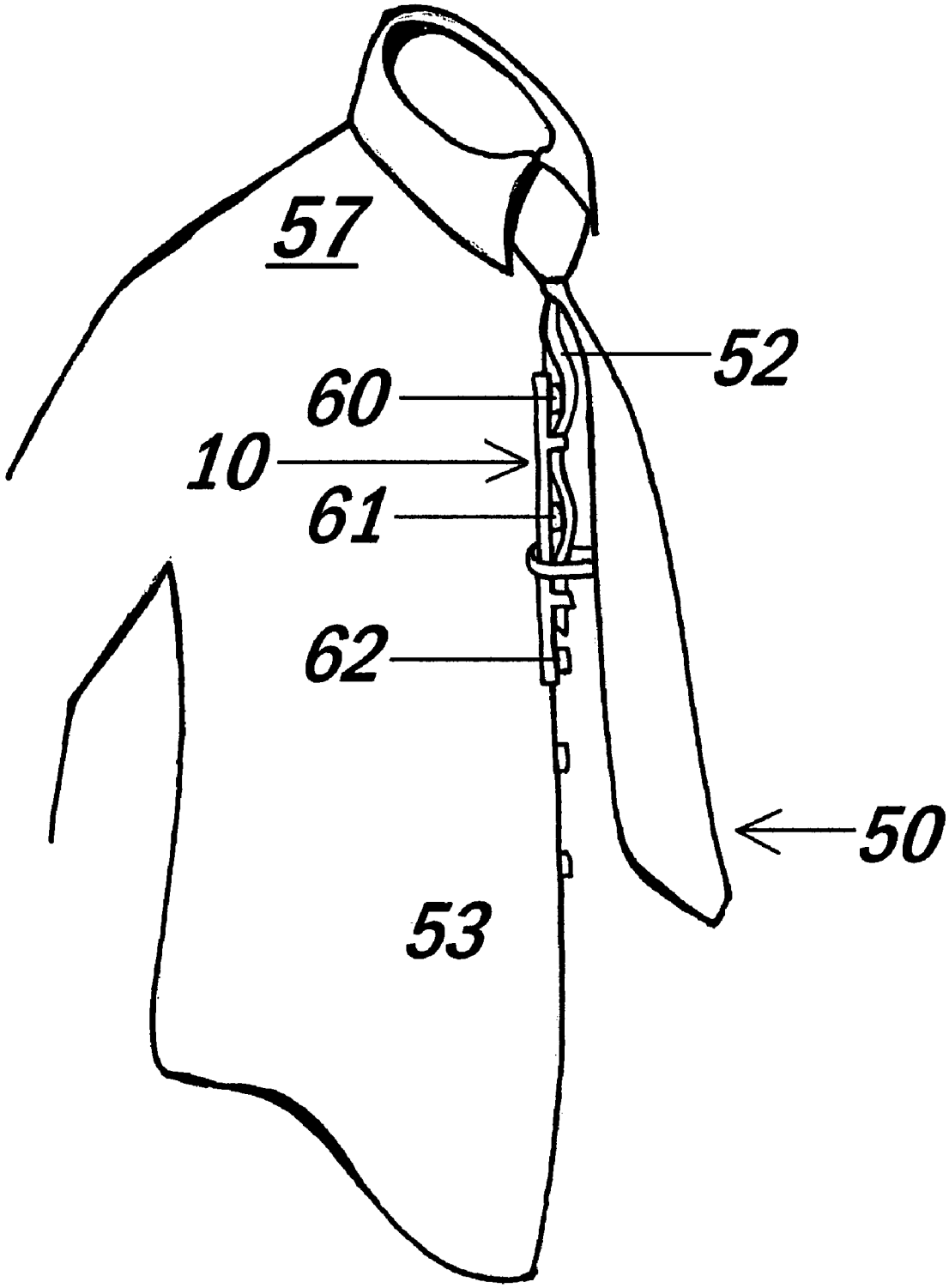
FIG. 10 is a perspective view of necktie fully connected to the apparatus in a different embodiment.

FIG. 10 is a perspective view of the necktie 50 attached to the apparatus 10 with the apparatus 10 connected to only the upper button hole 20 and lower button hole 22 on the apparatus 10 and the upper button 60 and lower button 62, respectively, on the shirt 57. The apparatus 10 and rear portion 52 of the necktie 50 are shown threaded through the neckties label 53. In this embodiment, the rear portion 52 of the necktie 50 is not threaded through the second tab 31.

Figure 11:
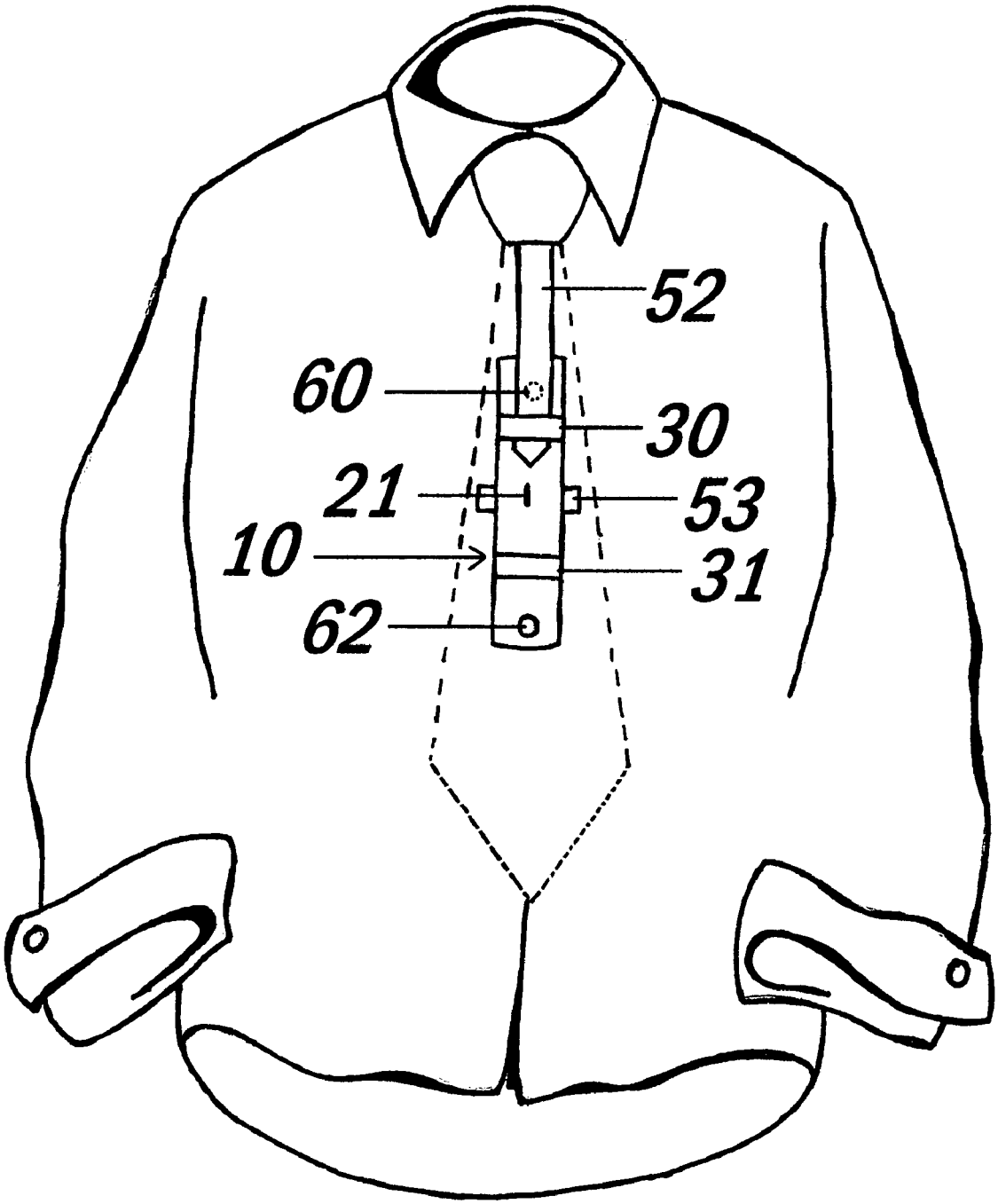
FIG. 11 is a perspective view of the rear portion of the necktie secured with the upper and middle buttons and the first tab to the apparatus.

FIG. 11 is a perspective view of the rear portion 52 of the necktie 50 secured with the upper and middle buttons 60 and 61, and the first tab 30 to the apparatus 10. The dashed lines are shown to represent the outline of the front portion 51 of the necktie 50. As discussed, the middle button hole 21 may align with the tie label 53. Also, the rear portion 52 of the necktie 50 may not be long enough to extend to the second tab 31. In this case, the upper button 60, shown with dashed lines, is buttoned and the lower button 62 is buttoned. To further secure the rear portion 52 of the necktie 50 the rear portion of the necktie 52 is inserted or threaded through the first tab 30.

It will be understood that the above description of the present invention is susceptible to various modifications, changes and adaptations, and the same are intended to be comprehended within the meaning and range of equivalents of the appended claims

The invention claimed is:

1. Apparatus for restraining a necktie having a front and a rear portion, said apparatus comprising:

a material having at least one button hole positioned for contact with at least one button on a shirt; and at least one tab attached to said material for supporting said rear portion of said necktie;

wherein the at least one button hole of the material further comprises upper, middle and lower button holes, said button holes are positioned for contact with upper, middle and lower buttons on said shirt;

wherein said at least one tab further comprises a first tab and a second tab attached to said material supporting said rear portion of said necktie, the first tab is positioned below the upper button hole and above the middle button hole and the second tab is positioned below the middle button hole and above the lower button hole.

2. The apparatus of claim 1, wherein said upper button hole is connected to said upper button hole of said shirt.

3. The apparatus of claim 2, wherein said rear portion of said necktie is inserted into said first tab or said second tab.

4. Apparatus for restraining a necktie having a front portion, a rear portion and a label attached to a back side of the front portion of said necktie, said apparatus comprising:

a material having upper, middle and lower button holes, said button holes are positioned for contact with upper, middle and lower buttons on a shirt; and a first tab and second tab that form a first loop and a second loop with the material such that said rear portion of said necktie is inserted through the first loop or the second loop, the first tab is positioned below the upper button hole and above the middle button hole and the second tab is positioned below the middle button hole and above the lower button hole wherein said material and said rear portion of the necktie are inserted into said label such that the material and the rear portion of the necktie are further secured to the back side of the front portion of the necktie by the label.

5. A method of restraining a necktie using an apparatus comprising a material having at least one button hole positioned for contact with at least one button on a shirt; and at least one tab in the form of a first loop and a second loop attached to said material comprising the steps of:

securing said necktie to a collar of the shirt;

connecting a first button on said shirt to a first button hole on said material;

inserting the rear portion of said necktie through said loop on the material to attach the necktie to the apparatus;

inserting said apparatus and the connected rear portion of the necktie through a label on a backside of the front portion said necktie; and connecting a second button on said shirt to a second button hole on said material wherein the first loop is positioned below the upper button hole and above the middle button hole and the second loop is positioned below the middle button hole and above the lower button hole.

* * * * *